US007156801B2

(12) United States Patent
Dircks et al.

(10) Patent No.: US 7,156,801 B2
(45) Date of Patent: Jan. 2, 2007

(54) DECANTER CENTRIFUGE WITH A SCREW CONVEYOR HAVING A VARYING PITCH

(75) Inventors: Klaus Dircks, Copenhagen (DK); Bent Madsen, Gentofte (DK)

(73) Assignee: Alfa Laval Copenhagen A/S, Soborg (DK)

( * ) Notice: Subject to any disclaimer, the term of this patent is extended or adjusted under 35 U.S.C. 154(b) by 0 days.

(21) Appl. No.: 10/509,836

(22) PCT Filed: Apr. 9, 2003

(86) PCT No.: PCT/DK03/00235

§ 371 (c)(1),
(2), (4) Date: May 16, 2005

(87) PCT Pub. No.: WO03/089146

PCT Pub. Date: Oct. 30, 2003

(65) Prior Publication Data

US 2005/0202950 A1 Sep. 15, 2005

(30) Foreign Application Priority Data

Apr. 22, 2002 (DK) ..... 2002 00598

(51) Int. Cl.
*B04B 1/20* (2006.01)

(52) U.S. Cl. ..... 494/54

(58) Field of Classification Search ..... 494/50–55; 210/380.1, 380.3
See application file for complete search history.

(56) References Cited

U.S. PATENT DOCUMENTS 1,383,313 A * 7/1921 Landreth ..... 494/53
3,430,850 A * 3/1969 Gilreath ..... 494/54
3,447,742 A * 6/1969 Thorbjorn et al. ..... 494/53
3,885,734 A 5/1975 Ying
3,934,792 A 1/1976 High et al.
4,245,777 A 1/1981 Lavanchy
4,378,906 A * 4/1983 Epper et al. ..... 494/54
4,381,849 A 5/1983 Conant
4,731,182 A * 3/1988 High ..... 210/374
5,306,225 A * 4/1994 Miyano et al. ..... 494/53
5,354,255 A 10/1994 Shapiro
5,584,791 A * 12/1996 Grimwood et al. ..... 494/54
5,653,673 A * 8/1997 Desai et al. ..... 494/27
6,024,686 A * 2/2000 Madsen ..... 494/54
6,572,524 B1 * 6/2003 Caldwell ..... 494/53

(Continued)

FOREIGN PATENT DOCUMENTS

DE 2907318 A1 8/1980

(Continued)

*Primary Examiner*—Charles E. Cooley
(74) *Attorney, Agent, or Firm*—Browdy and Neimark, PLLC

(57) ABSTRACT

The decanter centrifuge comprises a screw conveyor having a body (4), which carries a screw comprising one or more flights (7, 7') and having a nominal transport speed varying along the longitudinal axis. An inlet (6) is provided in the screw conveyor for the material to be separated. The screw conveyor is provided with a baffle (8, 8') dividing the separation chamber in a substantially cylindrical separation part (17) and an at least partially conical discharge part (18). Immediately upstream of the baffle (8, 8') a transition part (19) is provided between the separation part (17) and the discharge part (18), the screw conveyor (3) having a bigger nominal transport speed in the transition part (19) than in the separation part (17) immediately before the transition part (19), the change of the nominal transport speed being established by a change (21) of the screw pitch.

20 Claims, 3 Drawing Sheets

U.S. PATENT DOCUMENTS

2005/0202950 A1 * 9/2005 Dircks et al. ..... 494/54

FOREIGN PATENT DOCUMENTS

DE 3335873 A1 * 2/1985
DE 4041923 A1 7/1992
EP 0785029 A1 * 7/1997
EP 1260273 A1 * 11/2002
WO WO 9722411 A1 6/1997

* cited by examiner

DECANTER CENTRIFUGE WITH A SCREW CONVEYOR HAVING A VARYING PITCH

FIELD OF THE INVENTION

The present invention relates to a decanter centrifuge for separation of a supplied material in a light phase and a heavy phase, comprising an elongate bowl arranged for rotation about its longitudinal axis, said bowl having a separation chamber, a screw conveyor being provided in the separation chamber and being coaxial with the bowl, said screw conveyor comprising a body, which carries a screw comprising one or more flights and having a nominal transport speed varying along the longitudinal axis, an inlet with at least one inlet opening in the screw conveyor for supply of the material to the separated, and at least one discharge opening for the heavy phase in the bowl at one end of the screw conveyor, in which the screw conveyor is made to rotate relative to the bowl in view of conveying the heavy phase towards the discharge openings for the heavy phase, and in which the screw conveyor is provided with a baffle positioned between the inlet openings and the discharge openings, said baffle dividing the separation chamber in a substantially cylindrical separation part and an at least partially conical discharge part, the discharge openings for the heavy phase being positioned in the discharge part, the inlet openings being positioned at the opposite side of the baffle relative to said discharge openings.

DESCRIPTION OF RELATED ART

A decanter centrifuge of this kind is known from WO-A-97/22411, which discloses a decanter centrifuge having a baffle shaped as a rib extending from the upstream side of a screw turn as a part of a turn having a bigger pitch than the screw to the downstream side of a screw turn at an axial distance from its starting point.

U.S. Pat. No. 3,934,792 discloses a decanter centrifuge having a baffle extending axially from the upstream side of the screw turn to the downstream side of the adjacent screw turn. A similar baffle is described in U.S. Pat. No. 5,653,673.

U.S. Pat. No. 3,885,734, U.S. Pat. No. 4,245,777 and U.S. Pat. No. 4,381,849 disclose baffles extending tangentially around the screw conveyor.

The flight or flights of a screw conveyor defines/define a passageway between adjacent turns, through which material flows during the running of the decanter centrifuge. A baffle is in general a member barring a part of the cross section of the passageway at a distance from the interior wall of the bowl. If only one flight is provided, it forms a single passageway winding around the body of the screw conveyor, and the baffle will comprise a single member. If several flights are provided, a similar number of passageways will be defined between them, and the baffle will therefore comprise a member in each passageway.

In a decanter centrifuge a separation of the heavy phase and the light phase takes place in the separation part, whereby the light phase may be water and the heavy phase may be sludge to be drained off. The drained off sludge is conveyed by the screw through the bowl to the baffle, under the baffle, i.e. between the baffle and the interior wall of the bowl, and to the discharge openings, where the comparatively dry sludge leaves the centrifuge, the baffle preventing the water or the light phase from reaching the discharge openings for the heavy phase.

The separation part and the part of the screw present therein are designed with a view to obtaining the biggest possible efficiency of the drainage. However, an accumulation of the heavy phase immediately before the baffle may occur, partly on account of the throttling of the flow area of the heavy phase caused by the baffle, partly on account of the reduced area in the conical discharge part, which acts backwards in such a manner that the separation process in the separation part does not get the intended course, which moreover entails a poorer process economy and a poorer drainage.

It is the object of the invention to reduce this problem.

SUMMARY OF THE INVENTION

This object is according to the invention met in that immediately upstream of the baffle, seen in relation to the transport direction, a transition part is provided between the separation part and the discharge part, and that the screw conveyor has a bigger nominal transport speed in the transition part than in the separation part immediately before the transition part, the change of the nominal transport speed of the screw from the nominal transport speed in the separation part immediately before the transition part to the higher nominal transport speed in the transition part being established by a change of the screw pitch.

By nominal transport speed for the screw is to be understood the speed, at which a given part of the screw would convey the heavy phase without disturbance from the surrounding parts of the screw, like for instance downstream accumulation of heavy phase. The nominal transport speed depends in a non-linear way on the screw pitch and is highest at a pitch angle of approx. 450° relative to the tangential direction.

By designing the screw in accordance with the invention is attained that accumulation of the heavy phase in the discharge part will not take place to the same degree, as would otherwise be the case. Letting the increase of the transport speed take place before the baffle minimizes the risk of pulling to pieces the heavy phase, which at this point has the character of a coherent cake, which would entail a risk of the light phase breaking through to the discharge part, which must be avoided, as it is tantamount to a re-wetting of the heavy phase just drained.

The change of the screw pitch may be abrupt, which may be convenient from a constructional point of view, but the change of the screw pitch may alternatively be gradual.

In a preferred embodiment the pitch angle of the screw in the separation part is considerably smaller than 45° relative to the tangential direction, and the change of the screw pitch from the separation part to the transition part is an increase. This increase is preferably 40–80%.

In another embodiment the pitch angle of the screw in the separation part is considerably bigger than 45° relative to the tangential direction, and the change of the screw pitch is a decrease from the separation part to the transition part.

To obtain full effect of the invention the heavy phase, which is conveyed towards the baffle, should be conveyed at the increased speed over the whole peripheral extension of the baffle. Therefore, the screw has the bigger nominal transport speed over at least $\frac{1}{3}\times 1/n$ of a turn before the baffle, preferably over approximately $\frac{2}{3}\times 1/n$ of a turn, n being the number of flights, corresponding to an axial length of $\frac{1}{3}$ and preferably $\frac{2}{3}$, respectively, of the pitch in the transition part, if there is only one flight, or the axial distance between two adjacent turns, if several flights are present.

In an embodiment, in which the baffle has an axial extension, the border between the discharge part and the transition part is considered to be at the centre point of the axial extension of the baffle.

The inlet is preferably placed upstream of the transition part in the separation part itself. In this way the risk of turbulence, on account of the change of speed, disturbing the inlet flow is eliminated.

The screw pitch may be increasing in the separation part in a direction away from the transition part. In this manner known per se a decreasing concentration of the heavy phase in a direction away from the inlet and the discharge part is compensated for.

BRIEF DESCRIPTION OF THE DRAWING

The invention will now be explained in detail in the following by means of some examples of embodiments and with reference to the drawings, in which FIG. 1 in a somewhat schematic form shows a longitudinal section of a known decanter centrifuge having a bowl with a screw conveyor with an annular baffle disc, and FIG. 2 a screw conveyor in a first embodiment of the invention, FIG. 3 a screw conveyor according to a second embodiment, and FIG. 4 a screw conveyor in a third embodiment according to the invention.

DESCRIPTION OF THE PREFERRED EMBODIMENTS

Figure 1:
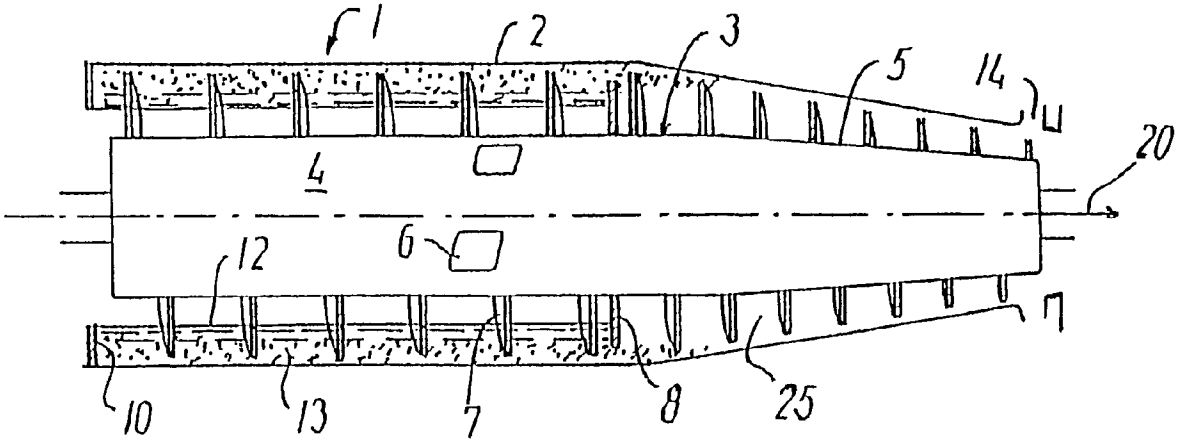
FIG. 1 PRIOR ART

The decanter centrifuge 1 in FIG. 1 has a hollow bowl 2 with a separation chamber containing a screw conveyor 3 having a body 4 with a screw with a flight 7, which is wound in a number of turns. The body 4 is substantially cylindrical and has a conical part 5 at one end. In the screw conveyor 3 inlet openings 6 for the material to be separated are provided, and in the bowl 2 discharge openings 14 for the separated heavy phase are provided. As indicated in the figure, the light phase 12 will be positioned closest to the body of the screw conveyor 4, whereas the heavy phase 13 is positioned at the interior side of the bowl 2. The light phase is taken away via a discharge edge 10 on the bowl. The heavy phase is conveyed by the screw turn towards the discharge openings 14 in the bowl at its conical end. The figure shows a baffle 8 comprising an annular disc, which is perpendicular to the longitudinal axis or axial direction of the screw conveyor.

Figure 2:
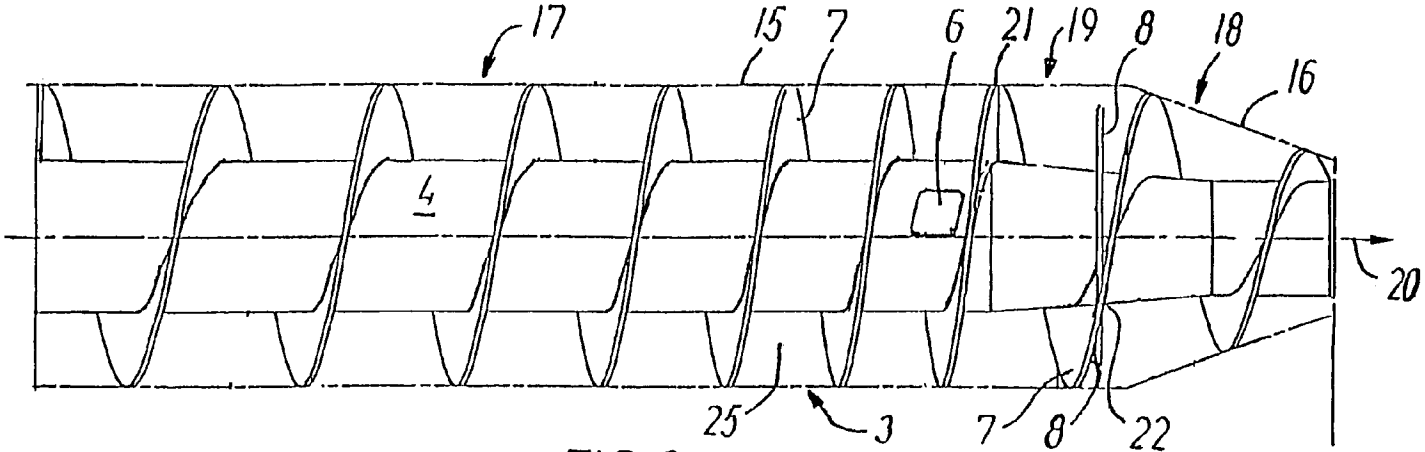

FIG. 2 shows a screw conveyor 3, which as the screw conveyor in FIG. 1 is provided with a baffle 8 in the form of an annular disc and an inlet opening 6. FIG. 2 shows by broken lines the enveloping surface for the screw turns of the flight 7. The enveloping surface comprises a cylindrical part 15 and a conical part 16. The enveloping surface corresponds with a suitable clear to the shape of the bowl, in which the screw conveyor is to be mounted.

The baffle 8 is positioned near the transition between the conical part 16 and the cylindrical part 15, and it divides substantially the centrifuge or the separation chamber in a cylindrical separation part 17 and a conical discharge part 18. In the embodiment the discharge part 18 comprises, however, a small portion of the cylindrical part 15.

The pitch of the screw turns varies along the screw conveyor 3 in its axial direction 20. Thus, there is at a point or at an axial position 21 an abrupt leap of the pitch of approximately 58%. The position 21 marks, on account of the change-constituted by the leap, a dividing line between the separation part 17 and a transition part 19 between the separation part 17 and the discharge part 18.

The pitch is in the embodiment constant from the position 21 to the discharge openings for the heavy phase.

The pitch of the screw turns in the separation part 17 is in this example decreasing in the axial direction 20 such that the pitch is smallest immediately before the transition part 19. The inlet 6 is situated in the separation part 17 shortly before the transition part 19.

Figure 3:
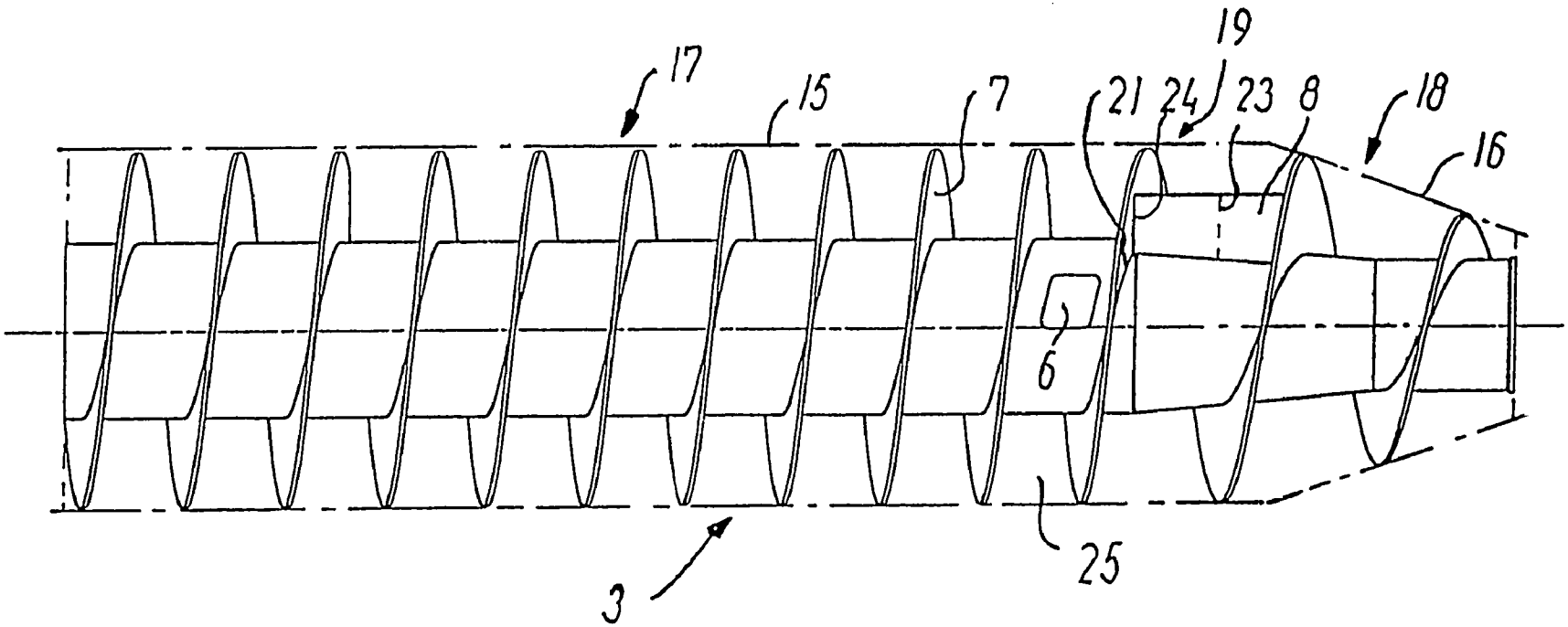

FIG. 3 shows another embodiment having a baffle 8 extending axially. The flight 7 of the screw conveyor 3 has in the position 21 a leap of the pitch, which is consequently bigger in the transition part 19 than in the separation part 17. In the separation part 17 the pitch is constant. On account of the axial extension of the baffle 8, the dividing line between the transition part 19 and the discharge part 18 is considered to lie at the axial centre point 23 of the baffle. As the position 21 is somewhat downstream of the starting point 24 of the baffle, the position 21 will lie slightly more than a half pitch before the centre point 23 of the baffle. The pitch of the flight 7 is, in the screw conveyors described up till now, equal to the axial dimension of the passageway 25 formed between the adjacent turns of the flight 7, and the pitch angle of the flight 7 in the separation part 17 is substantially smaller than 45° relative to the tangential direction.

Figure 4:
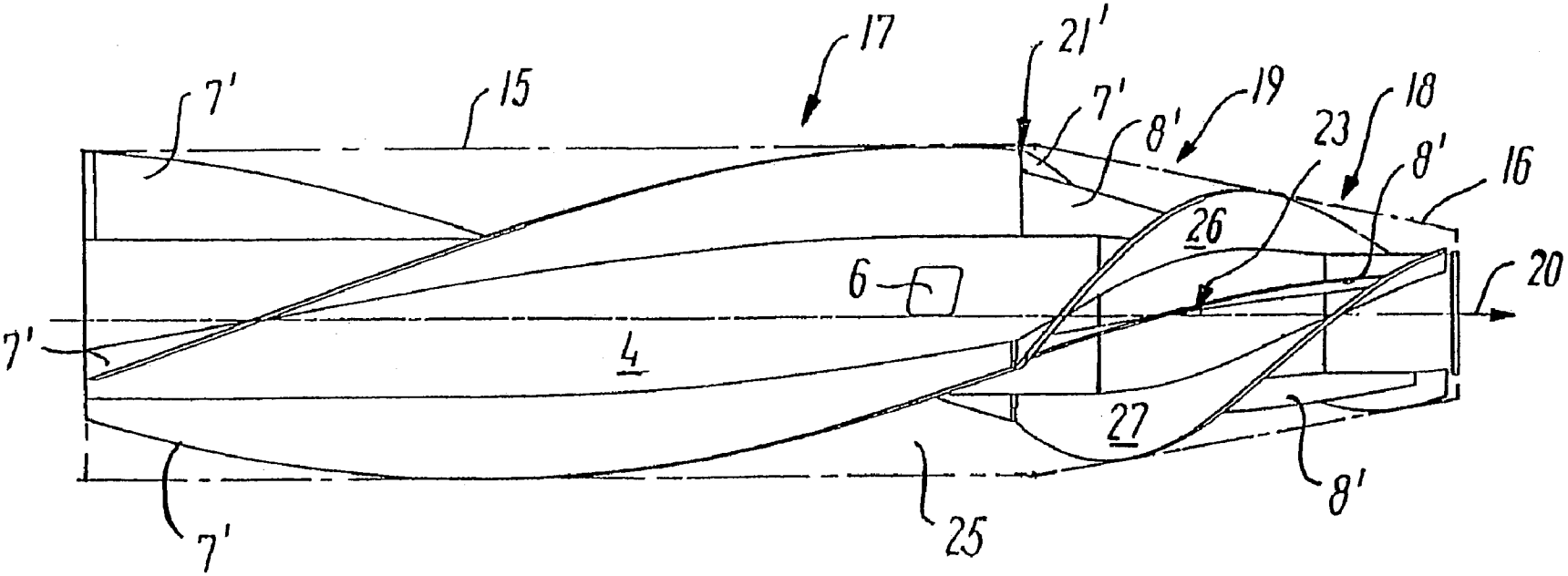

FIG. 4 shows an embodiment, in which the screw of the screw conveyor 3 has three flights 7' having a pitch angle substantially bigger than 45° relative to the tangential direction in the separation part 17. At an axial position 21' the pitch is changed, the pitch angle being changed in direction of 45°, following which the nominal transport speed increases.

At the position 21' a baffle member 8' extends from each flight 7', said baffle member extending as a part of a turn having a higher pitch than the flights 7' in the transition part 19 and the discharge part 18, but with the same rotational direction such that the baffle members 8' extend from a downstream side surface 26 of a flight 7' to an upstream side surface 27 of an adjacent flight 7'. In the embodiment shown in FIG. 4, the baffle members 8' have the same pitch as the flights 7' in the separation part, but that need not be the case.

The baffle members 8' extending from the position 21' and having a pitch smaller than 90° (axial direction), and the dividing line between the transition part 19 and the discharge part 18 being counted to lie at the axial centre point 23 of the baffle members, the leap regarding the nominal transport speed occurs more than ⅙ (½×⅓ (3=the number of flights)) of a flight upstream of the transition part corresponding to more than half of the axial extension of a passageway 25 between two adjacent flights 7' in the transition part.

A centrifuge with a screw conveyor according to the invention works in the following way.

Material to be separated, for example aqueous sludge, is led into the separation chamber through the inlet 6. The sludge flows through the passageway 25 established by the flight 7 of the screw turn, or the passageways 25 established by the flights 7', towards the left of the figures. On its way, the heavy phase sediments, i.e. the sludge, as indicated in FIG. 1.

The screw conveyor 3 pulls on account of its rotation relative to the bowl 2 the sedimented sludge to the right of the figures (downstream direction). The sludge is compressed in the separation part 15 up to the axial position 21. At this point, the sludge forms a coherent, comparatively dry cake.

From the position 21 the sludge is accelerated on account of the change of the pitch of the flight 7 or the flights 7'. The position 21 is in the embodiment in FIG. 2 positioned approximately ⅔ turn before the intersection point 21 of the screw turn 7 with the baffle 8 corresponding to an axial distance between the position 21 and the point 22 of ⅔ of the pitch of the screw turn or the axial dimension of the passageway at this point. In the embodiments in FIGS. 3 and 4, the position 21 is positioned a little bit more than ½ time the axial dimension of the passageway 25 upstream of the axial centre point 23 of the baffle 8 or the baffle members 8'. In this manner the changing point of the transport speed is situated sufficiently far from the baffle 8, 8' to convey the sludge along the periphery of the entire baffle at the increased speed.

The space between the periphery of the baffle 8 and the interior wall of the bowl 2 is smaller than the thickness of the sludge at the point 21. The increased speed in the transition part 19 compensates to a certain degree for this difference. However, compensation is somewhat below 100%, as a compensation of 100% or more could entail the risk that the sludge cake might be pulled to pieces, which may result in a break through of the light phase under and past the baffle 8.

The increased speed also compensates for the reduced cross-section area of the conical part of the bowl 2 in the discharge part 18.

Though different embodiments of screw conveyors 3 according to the invention have been described herein, said embodiments having different combinations of flight numbers and pitch angles and baffle types, it should be understood that in particular flight pitch angles and type of baffle may be combined in any way within the scope of the invention.

The invention claimed is:

1. A decanter centrifuge for separation of a supplied material in a light phase and a heavy phase, comprising an elongate bowl arranged for rotation about its longitudinal axis, said bowl having a separation chamber, a screw conveyor being provided in the separation chamber and being coaxial with the bowl, said screw conveyor comprising a body, which carries a screw comprising one or more flights and having a nominal transport speed varying along the longitudinal axis, an inlet with at least one inlet opening in the screw conveyor for supply of the material to the separated, and at least one discharge opening for the heavy phase in the bowl at one end of the screw conveyor, in which the screw conveyor is made to rotate relative to the bowl in view of conveying the heavy phase towards the discharge openings for the heavy phase, and in which the screw conveyor is provided with a baffle positioned between the inlet openings and the discharge openings, said baffle dividing the separation chamber in a substantially cylindrical separation part and an at least partially conical discharge part, the discharge openings for the heavy phase being positioned in the discharge part, the inlet openings being positioned at the opposite side of the baffle relative to said discharge openings, wherein immediately upstream of the baffle, seen in relation to the transport direction, a transition part is provided between the separation part and the discharge part, and the screw conveyor has a bigger nominal transport speed in the transition part than in the separation part immediately before the transition part, the change of the nominal transport speed of the screw from the nominal transport speed in the separation part immediately before the transition part to the higher nominal transport speed in the transition part being established by a change of the screw pitch.

2. A decanter centrifuge according to claim 1, wherein the change of the screw pitch is abrupt.

3. A decanter centrifuge according to claim 2, wherein the pitch angle of the screw in the separation part is considerably smaller than 45° relative to the tangential direction and that the change of the screw pitch is an increase.

4. A decanter centrifuge according to claim 2, wherein the pitch angle of the screw in the separation part is considerably bigger than 45° relative to the tangential direction and that the change of the screw pitch is a decrease.

5. A decanter centrifuge according to claim 1, wherein the change of the screw pitch is gradual.

6. A decanter centrifuge according to claim 5, wherein the pitch angle of the screw in the separation part is considerably smaller than 45° relative to the tangential direction and that the change of the screw pitch is an increase.

7. A decanter centrifuge according to claim 5, wherein the pitch angle of the screw in the separation part is considerably bigger than 45° relative to the tangential direction and that the change of the screw pitch is a decrease.

8. A decanter centrifuge according to claim 1, wherein the pitch angle of the screw in the separation part is considerably smaller than 45° relative to the tangential direction and that the change of the screw pitch is an increase.

9. A decanter centrifuge according to claim 8, wherein said increase is 40–80%.

10. A decanter centrifuge according claim 8, wherein the screw has the bigger nominal transport speed over at least ⅓×1/n of a turn before the baffle, n being the number of flights.

11. A decanter centrifuge according to claim 1, wherein the pitch angle of the screw in the separation part is considerably bigger than 45° relative to the tangential direction and that the change of the screw pitch is a decrease.

12. A decanter centrifuge according claim 11, wherein the screw has the bigger nominal transport speed over at least ⅓×1/n of a turn before the baffle, n being the number of flights.

13. A decanter centrifuge according to claim 1, wherein the screw has the bigger nominal transport speed over at least ⅓×1/n of a turn before the baffle, n being the number of flights.

14. The decanter centrifuge of claim 13, wherein said bigger nominal transport speed is more than about ⅔×1/n of a turn.

15. A decanter centrifuge according to claim 13, wherein the inlet is placed upstream of the transition part in the separation part.

16. A decanter centrifuge according to claim 1, wherein the inlet is placed upstream of the transition part in the separation part.

17. A decanter centrifuge according to claim 16, wherein the baffle has an axial extension, the border between the discharge part and the transition part being positioned at the centre point of the axial extension of the baffle.

18. A decanter centrifuge according to claim 1, wherein the baffle has an axial extension, the border between the discharge part and the transition part being positioned at the centre point of the axial extension of the baffle.

19. A decanter centrifuge according to claim 18, wherein the screw pitch is increasing in the separation part in a direction away from the transition part.

20. A decanter centrifuge according to claim 1, wherein the screw pitch is increasing in the separation part in a direction away from the transition part.

* * * * *